United States Patent [19]

Coleman

[11] Patent Number: 4,488,368

[45] Date of Patent: Dec. 18, 1984

[54] SIGN WITH PERIMETER FLANGE FOR UNIVERSAL MOUNTING

[76] Inventor: Kelly R. Coleman, 1910 Saddle Hill Rd. South, Dunedin, Fla. 33528

[21] Appl. No.: 398,283

[22] Filed: Jul. 14, 1982

Related U.S. Application Data

[63] Continuation of Ser. No. 854,253, Nov. 23, 1977, abandoned.

[51] Int. Cl.[3] ..... G09F 13/04

[52] U.S. Cl. ..... 40/564; 40/549; 40/574

[58] Field of Search ..... 40/564, 549, 572, 574

[56] References Cited

U.S. PATENT DOCUMENTS

| | | | |
|---|---|---|---|
| 1,600,243 | 9/1926 | Passmore | 40/564 |
| 1,808,456 | 6/1931 | Dwyer et al. | 40/564 |
| 3,848,349 | 11/1974 | Olsen | 40/549 |

FOREIGN PATENT DOCUMENTS

| | | | |
|---|---|---|---|
| 819985 | 8/1969 | Canada | 40/564 |
| 1184505 | 3/1970 | United Kingdom | 40/564 |

*Primary Examiner*—Gene Mancene
*Assistant Examiner*—Cary E. Stone
*Attorney, Agent, or Firm*—Laurence R. Brown

[57] ABSTRACT

A sign structure is shown for universal mounting on generally vertically extending support means. The body of the sign is simple to manufacture and is formed of extruded aluminum bar stock in a manner to have a rigidifying mounting flange surrounding the perimeter of the sign, the flange being also provided for attaching the sign to the support means. The sign is fully sealed against the elements and may be illuminated by suitable means preferably positioned within the inside of the body of the sign.

1 Claim, 3 Drawing Figures

Fig. 1
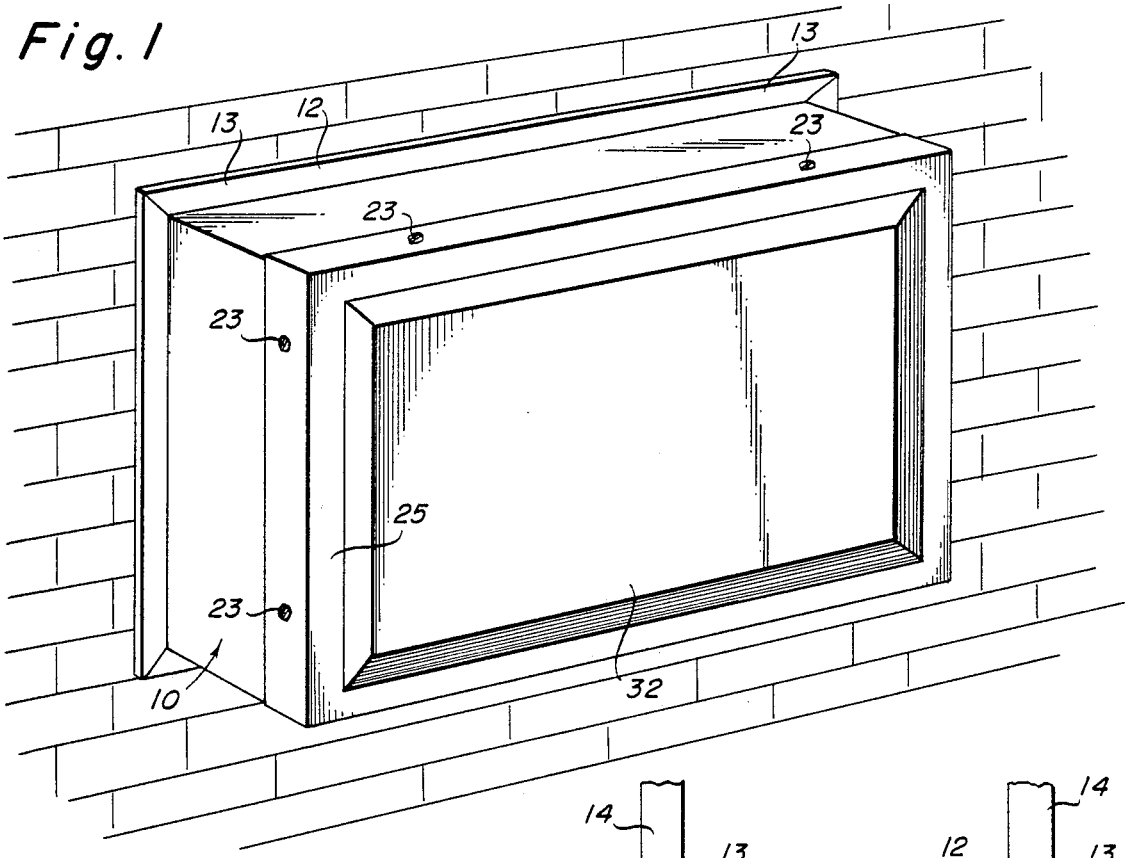
Fig. 2
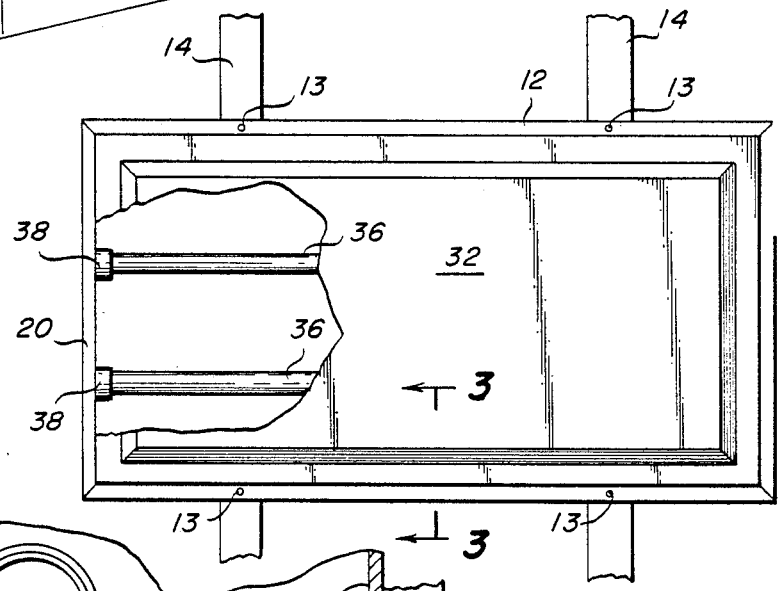
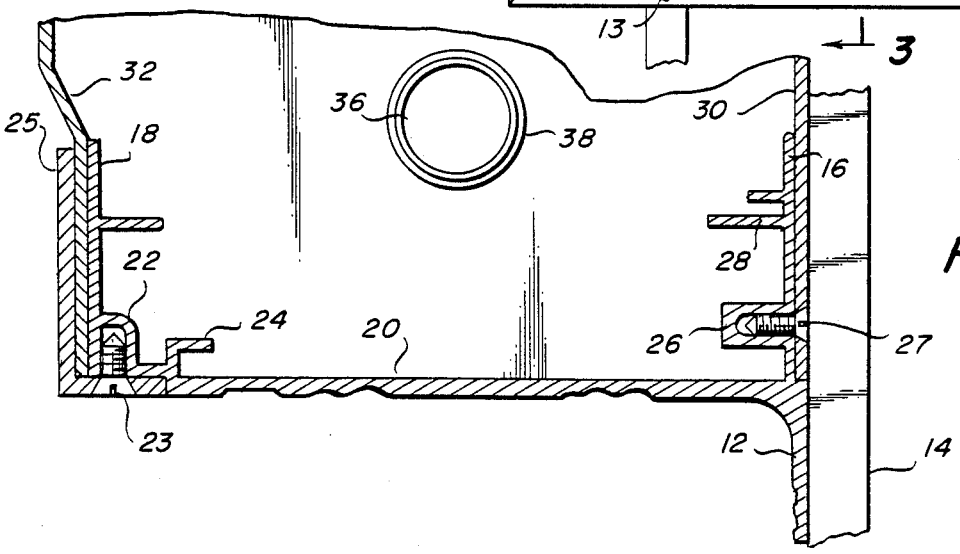
Fig. 3

SIGN WITH PERIMETER FLANGE FOR UNIVERSAL MOUNTING

This is a continuation of application Ser. No. 854,253 filed Nov. 23, 1977, abandoned.

BACKGROUND

In the past, box-like structures have been provided adapted to support signs for advertising and the like. A typical structure in the prior art is shown in U.S. Pat. No. 3,848,349 to Olsen, Nov. 19, 1974, that shows a rather complicated box-like housing for a sign. Such devices are made up by assembling a plurality of interfitted parts to produce an assembly for supporting display indicia.

BRIEF DESCRIPTION OF THIS INVENTION

The sign structure here shown includes a frame produced from extruded aluminum bar stock having integral flange means. This extruded bar has a cross-sectional shape which, when it is assembled to form the frame for a sign, provides flanges that produce a rigid box-like structure having windows in both of the vertical sides of the body of the sign. One of the integral flange means on the assembled body faces inwardly from the periphery of the frame and forms a support for a translucent cover for displaying the message carried by the sign. A flange means on the other side of the body of the sign protrudes from the periphery and is adapted to be attached to suitable support means such as the wall of a building or horizontal or vertical post means. The sign frame includes additional inwardly directed flange means to stiffen the body structure that can be used to provide a double-faced sign when it is carried on support means adapted to display the opposite sides of the frame. The sign may be illuminated by means of a light source placed within the body of the sign or by other means for directing light from a suitable source against the sign.

It is a principal object of this invention to provide a rugged sign frame adapted to be supported on support means.

Another object of the invention is to provide a sign frame having integral flange means for supporting the frame on a suitable support and carrying a sign cover.

Another object of the invention is to utilize an extruded rod stock having integral flanges for forming a frame for a sign.

Another object of the invention is to utilize an extruded aluminum rod shape that may be formed into a sign frame having a protruding flange for mounting the sign on the support means and inwardly directed flange means for supporting display panel means on one or both sides of the sign.

Other objects will appear from the specification below.

IN THE DRAWINGS

FIG. 1 is a perspective view of the sign mounted on the side of a building;

FIG. 2 is a front elevation partly broken away showing the sign mounted on spaced vertical support posts to provide a double-faced sign; and FIG. 3 is a sectional view partly broken away looking along line 3—3 of FIG. 2.

DETAILED DESCRIPTION

The sign shown in FIG. 1 includes a hollow body or frame 10 having an integral primary flange 12 protruding from its periphery for mounting the sign on a suitable support such as the side wall of a building or vertical or horizontal supporting posts by bolts 13. The flange 12 can be easily attached to the wall or as shown in FIG. 2, the flange 12 can be supported on spaced apart vertically disposed posts 14 so that both of the vertical faces of the sign can be used for display purposes.

The frame 10 is preferably formed from an extruded aluminum rod having the cross-sectional shape shown in FIG. 3. The extrusion has an outwardly turned flange 12 and inwardly turned secondary flanges 16 and 18 formed integral on a web 20. These several flanges are spaced apart over the width of the web and stiffen the walls of the frame or box 10 of the sign. The sign frame is preferably formed from four lengths of the extruded bar cut to form the solid frame 10.

The outwardly exposed face of flange 18 is disposed at a right angle with respect to the general plane of web 20 and the intersection of this flange and web elements is formed with two U-shaped channels 22 and 24. The open ends of these U-shaped channels are disposed at right angles one with respect to the other, the open side of channel 22 facing outwardly around the periphery of the flange 18 of the frame and channel 24 being disposed on the inside of web 20 so that its open end faces the interior of the sign. These channel elements, 22 and 24, serve to stiffen the corner of the frame 10 of the sign and additionally, as will appear more fully below, channel 22 receives and conceals the self-threading screw 23 means used to attach a picture frame means 25 to the box to hold a translucent cover supported against the outer face of flange 18 over one of the open faces of the sign frame 10.

The opposite side of the sign has a window defined by the inturned flange 16. Flange 16 is extruded with two generally U-shaped stiffening webs 26 and 28. The open ends of these U-shaped stiffening webs face in opposite directions with the open end of web 26 facing outwardly, as shown in FIG. 3. The generally planar outer face of flange 16 is spaced inwardly or offset a short distance from the planar bearing surface of the protruding flange 12 that faces against the support for the sign to provide a space for a translucent plastic or other cover 30 to be mounted over the window defined by flange 16. A plurality of self-threading screw means 27 of proper size to have their threads engage in the walls of web 26, are used to hold the cover in place. Such cover 30 can be used to seal the frame when body 10 is mounted on the wall of a building or the translucent cover 30 can be used for an illuminated display panel when the frame is supported as shown in FIG. 2.

A sign constructed as above described, may be illuminated by suitable elongated light means 36 carried at their opposite ends by lamp sockets 38 supported in the inner side of web 20 to be disposed within the interior of the sign defined by the frame 10. A conventional source of power and circuitry are connected to sockets 38 to energize the lamps when necessary.

The sign has the protruding integral flange 12 around its perimeter to produce a sign having a universal adaptability for mounting the sign on any suitable support means such as a wall or vertical or horizontal support posts. The basic frame 10 of the sign means is formed of extruded aluminum bar stock having the stiffening flanges described above. The oppositely disposed vertical faces of the frame have windows defined by the inturned flanges 16 and 18 that are adapted to be covered either on one side or both sides with translucent plastic covers. The covers may be held in place respectively with the picture frame means 25 held in place by a plurality of self-tapping screw means 23 on the one side of the sign that engage themselves in the walls of channel 22 and by the insertion of the self-tapping screws 27 spaced around the periphery of cover 30 on the other side that engage the walls of channel 26.

Any suitable message can be produced on one or both of the covers 30 and 32 for display. The sign is preferably illuminated from the inside by suitable means and has a structure that is adapted for universal mounting on any suitable means for a display mounted on either one or both of its faces.

The above describes the preferred form of this invention. It is possible that modifications thereof may occur to those skilled in the art that will fall within the scope of the following claims.

What is claimed is:

1. A sign comprising a hollow box-like frame body surrounding an interior space, said frame body on at least one side thereof defining a window in which is located a translucent sign facing, said sign body having four enclosure walls of single integral aluminum extrusions of L-shape in transverse cross section, each being extruded from a single piece of metal and each comprising a web wall enclosure portion and a primary mounting end flange portion projecting from the web portion substantially perpendicular thereto and from one side thereof, said four walls being interconnected to each other in an arrangement such that the web portions surround the interior of the sign, a pair of integrally extruded secondary flanges extending from the opposite side of said web wall from said mounting flange one at each end of said web, U-shaped channels integrally formed on said secondary flanges and having open ends extending in opposite directions, self-taping screw mount securing means receivable in said U-shaped channels on said secondary flanges for fastening closure members about the edges of the walls of said secondary flanges at two opposite window positions thereby forming sign mounting means, the frame body walls constituting four extruded web members of a single piece of aluminum with integrally extending primary and secondary flanges directed from opposite surfaces to stiffen the walls, to mount end closure panels and to mount the sign body on a supporting structure.

* * * * *